US006468198B1

(12) United States Patent
Mackel

(10) Patent No.: US 6,468,198 B1
(45) Date of Patent: Oct. 22, 2002

(54) METHOD AND DEVICE FOR ADJUSTING THE LIQUID CONTENT OF A SOLID WITHDRAWN FROM A SELF-DISCHARGING CENTRIFUGAL DRUM OF A SEPARATOR

(75) Inventor: Wilfried Mackel, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/762,053

(22) PCT Filed: Jul. 5, 1999

(86) PCT No.: PCT/EP99/04663

§ 371 (c)(1),
(2), (4) Date: Feb. 1, 2001

(87) PCT Pub. No.: WO00/07733

PCT Pub. Date: Feb. 17, 2000

(30) Foreign Application Priority Data

Aug. 4, 1998 (DE) ..... 198 35 120

(51) Int. Cl.[7] ..... B04B 1/08; B04B 11/04

(52) U.S. Cl. ..... 494/37; 494/47; 494/56; 494/70

(58) Field of Search ..... 494/1–6, 37, 47, 494/48, 56, 61, 68–70

(56) References Cited

U.S. PATENT DOCUMENTS 3,656,685 A * 4/1972 Kjellgren 3,741,467 A * 6/1973 Kjellgren

FOREIGN PATENT DOCUMENTS

| | | | |
|---|---|---|---|
| FR | 1031187 | * | 6/1983 |
| WO | 86/02021 | * | 4/1986 |

OTHER PUBLICATIONS

Hanno–R. Lehmann, Karl–Heinz Zettier, *Whey Processing Lines*, Technical–scientific documentation No. 6, Third revised edition 1988, Published by Westfalia Separator AG.

* cited by examiner

*Primary Examiner*—Charles E. Cooley
(74) *Attorney, Agent, or Firm*—Barnes & Thornburg

(57) ABSTRACT

The invention is a method and apparatus for adjusting a liquid content of a liquid and solid mixture withdrawn from a self-discharging centrifugal drum of a separator. The method includes the steps of: feeding a solid and liquid mixture into the separator; rotating the drum; separating the liquid and solid mixture during the rotation; bringing the separator to a halt; aspirating the liquid remaining in the interior of the centrifugal drum until a quantity remains which corresponds to a required consistency of a solid; and emptying the centrifugal drum of the solid with the required consistency from the centrifugal drum at a suitable rotational speed. The apparatus is a separator including: a self-discharging centrifugal drum; withdrawal openings; a solid space and a separating space; a feeding tube; a shutoff element; and a piston-type slide valve. A connection piece for the connection of a suction device is arranged below the shut-off element.

5 Claims, 1 Drawing Sheet

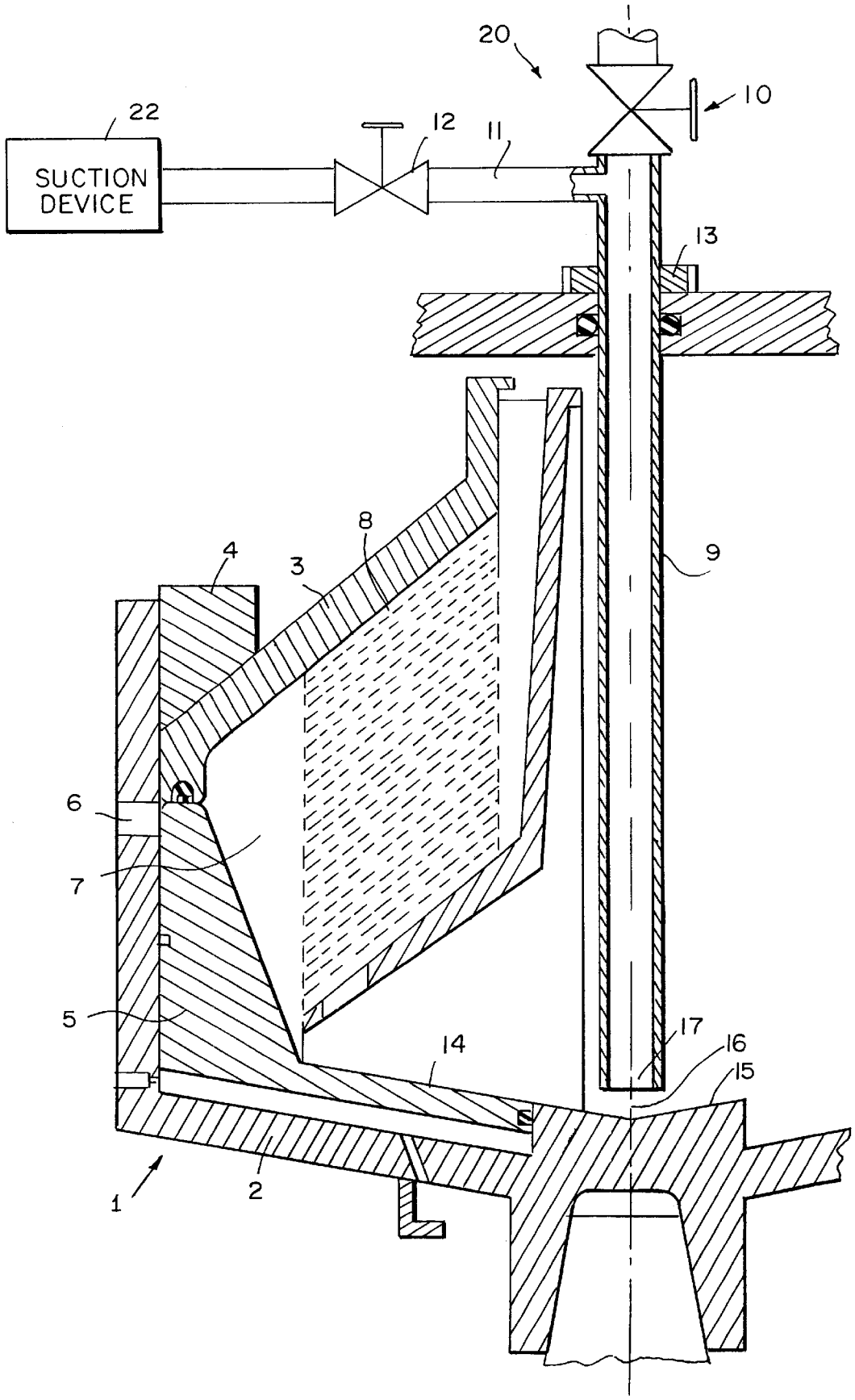
20
10
22
SUCTION DEVICE
12
11
13
8
4
3
9
6
7
5
14
17
16
15
1
2

METHOD AND DEVICE FOR ADJUSTING THE LIQUID CONTENT OF A SOLID WITHDRAWN FROM A SELF-DISCHARGING CENTRIFUGAL DRUM OF A SEPARATOR

BACKGROUND AND SUMMARY OF THE INVENTION

The invention relates to a method and a device for adjusting the liquid content of a solid withdrawn from a self-discharging centrifugal drum of a separator, and to a device for implementing this method.

In the case of several products, it is desirable that the solid withdrawn from self-discharging centrifugal drums has a content of dry substance which is as large as possible. It is therefore preferred to prevent liquid from being ejected from the drum along with the solid. In order to achieve this, a so-called "partial discharge" is applied in which the centrifugal drum is opened only for such a short time that the majority of solids can escape.

In the case of other products, it is desirable to eject the solid with a liquid content which determines the endeavored consistency.

This cannot be achieved by means of the known separators and their method of operation.

It is an object of the invention to design a method and a device of the initially mentioned type such that, prior to the withdrawal of the solid from the centrifugal drum, the liquid content can be adjusted which determines the consistency.

According to the invention, when the separator is brought to a halt after separation, the liquid remaining in the interior of the centrifugal drum is aspirated until a quantity remains which corresponds to the required consistency of the solid. Subsequently the centrifugal drum is emptied at a suitable rotational speed, and then the solid is withdrawn from the centrifugal drum.

For the aspiration of a portion of the liquid from the interior of the centrifugal drum, the feeding tube feeds the solid/liquid mixture to the centrifugal drum and which can be adjusted with respect to its height and, in the lower end position, extends into the proximity of the drum bottom.

When the centrifugal drum is stopped, an inward and downward sloped drum bottom guides the residual fluid toward the interior and collects in the area of the lower end of the centrally arranged feeding tube.

Because of the axial displaceability of the feeding tube, the free end can be moved to the lowest point of the drum bottom, so that the liquid can also be almost completely aspirated through the feeding tube when the inflow is shut off. Furthermore, by way of the adjusted distance of the lower opening of the feeding tube from the drum bottom, a remaining fluid quantity can be adjusted and the consistency of the withdrawn solid can be influenced.

By using the feeding tube as a suction tube when the inflow of the solid/liquid mixture is switched off, a simple construction is obtained for carrying out the suction operation in order to withdraw a desired liquid quantity from the interior of the centrifugal drum.

The temporary use of the feeding tube as a suction tube is possible in the case of stationary as well as co-rotating feeding tubes.

Other objects, advantages and novel features of the present invention will become apparent from the following detail description of the invention when considered in conjunction with the accompanying drawings.

BRIEF DESCRIPTION OF THE DRAWINGS

The drawing is a schematic vertical sectional view of a centrifugal drum of a separator according to the principles of the invention.

DETAILED DESCRIPTION OF THE PREFERRED EMBODIMENTS

The centrifugal drum 1 is composed of the bottom part 2, the top part 3 and a connection ring 4. In the bottom part 2, a piston-type slide valve 5 is slidably disposed and, in the indicated operating position, closes the withdrawal openings 6 arranged in a distributed manner on the circumference for the solid which, during the operation of the separator, collects in the solid space 7.

The centrifugal drum 1 also has a separating space 8 in which a plate stack is arranged.

The feeding of the solid/liquid mixture takes place through a feeding tube 9 which can be shut off in the upper area by means of a shut-off element 10.

Below the shut-off element 10, a connection piece 11 branches off the feeding tube 9, in which connection piece 11 and a shut-off valve 12 are arranged and connected with a suction device 22.

The feeding tube 9 can be adjusted in the axial direction, specifically by means of an adjusting device 13 which is only outlined in the drawing.

The bottom of the centrifugal drum is composed of a ring surface 14 of the piston-type slide valve 5 and of a ring surface 15 of the bottom part 2. The illustration shows that the surfaces 14 and 15 extend inward and downward toward the center 16 and thus at a gradient, so that, when the centrifugal drum is stopped, the remaining fluid collects in the central lower area of the centrifugal drum. The distance of the lower opening 17 of the feeding tube 9, which is temporarily used as a suction tube, can be precisely adjusted so that, as a result, the liquid quantity is determined which remains in the centrifugal drum and, after the restarting of the separator 20, when the withdrawal openings 6 are opened up, the determined liquid quantity is withdrawn together with the solid.

Generally, after feeding a solid/liquid mixture through feeding tube 9 and running the separator 20, the method of operation of the centrifugal drum 1 comprises the following steps for adjusting a liquid content of a liquid and solid mixture withdrawn from the self-discharging centrifugal drum 1 of separator 20: the separator 20 is brought to a halt; the liquid remaining in the interior of the centrifugal drum 1 is aspirated until a quantity remains which corresponds to a required consistency; and then, the centrifugal drum 1 is emptied at a suitable rotational speed.

When the centrifugal drum 1 is stopped, an inward and downward sloped drum bottom 2 guides residue fluid (not shown) toward the interior and it collects in an area of the lower end of the centrally arranged feeding tube 9. The feeding tube 9 can be axially displaced by use of an adjusting device 13 and a free end can be moved to the lowest point of the drum bottom 2 so that the liquid can be almost completely aspirated through the feeding tube 9 when the inflow of material is shut off by shut-off element 10. By adjusting the distance of the lower opening 17 of the feeding tube 9 from the drum bottom 2, a remaining fluid quantity can be adjusted and the consistency of the withdrawn solid can be influenced. That can be accomplished because the feeding tube 9 is used as a section tube when the inflow of the solid/liquid mixture is switched off at element

10. A connection piece 11 branches off from feeding tube 9 and connects to a suction device 22 via shut off valve 12. This suction arrangement carries out a suction operation in order to withdraw a desired liquid quantity from the interior of the centrifugal drum 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A method for adjusting a liquid content of a liquid and solid mixture withdrawn from a self-discharging centrifugal drum of a separator, comprising the steps of:

feeding a solid and liquid mixture into the separator;

rotating the drum to separate the liquid and solid mixture;

bringing the separator to a halt, aspirating the liquid remaining in the interior of the centrifugal drum until a quantity remains which corresponds to a required consistency of a solid, and emptying the solid with the required consistency from the centrifugal drum at a suitable rotational speed.

2. The method according to claim 1, wherein the aspirating step includes using a feeding tube for feeding the mixture to the centrifugal drum and wherein, the feeding tube can be axially adjusted to a lower end position extending to an area near a bottom of the drum.

3. A separator for adjusting the liquid content of a liquid and solid mixture withdrawn from a centrifugal drum, the separator comprising:

a self-discharging centrifugal drum;

withdrawal openings configured on the centrifugal drum having a solid space and a separating space equipped with a plate stack, as well as a feeding tube for feeding a liquid and solid mixture, a shutoff element for closing off an upper area of the feeding tube;

a piston-type slide valve positioned to selectively open or close the withdrawal openings; wherein the feeding tube extends into the proximity of the bottom of the drum and is adjustable in an axial direction, and wherein a connection piece for the connection of a suction device is arranged below the shut-off element, the bottom of the centrifugal drum having a gradient toward the center in which the feeding tube is arranged.

4. The separator according to claim 3, further comprising a shutoff valve arranged in the connection piece leading to the suction device.

5. The separator according to claim 3, further comprising an adjusting device for axial adjustment of the feeding tube.

* * * * *